United States Patent [19]

Lewis et al.

[11] 3,993,289

[45] Nov. 23, 1976

[54] MODULAR RAIL FENCE

[76] Inventors: Edward Lewis, 95 Parkwood Drive, Snyder, N.Y. 14226; Edward Michalowski, 293 Hamilton Drive, Tonawanda, N.Y. 14150

[22] Filed: Feb. 18, 1975

[21] Appl. No.: 550,837

[52] U.S. Cl. ..... 256/59; 256/65

[51] Int. Cl.[2] ..... E04H 17/14

[58] Field of Search ..... 256/59, 65, 24, 47, 256/32, DIG. 6

[56] References Cited

UNITED STATES PATENTS

| | | | |
|---|---|---|---|
| 2,856,652 | 10/1958 | Colton | 256/59 |
| 3,002,493 | 10/1961 | Galamba | 256/59 |
| 3,410,527 | 11/1968 | Uroshevich | 256/32 |
| 3,499,631 | 3/1970 | Heldenbrand | 256/59 |
| 3,848,854 | 11/1974 | De Barbieri | 256/65 |
| 3,910,561 | 10/1975 | Fornells | 256/59 |

*Primary Examiner*—Werner H. Schroeder
*Assistant Examiner*—Doris L. Troutman
*Attorney, Agent, or Firm*—Ashlan F. Harlan, Jr.

[57] ABSTRACT

A modular rail fence construction adapted for easy erection and removal characterized by rails of predetermined standard length, posts that comprise a shell surrounding and supported by a metal pipe driven into the ground, the post shells being assembled, on site if desired, to provide posts of the various types required, and connecting devices for joining the rails and posts that allow relative angular movement therebetween.

22 Claims, 13 Drawing Figures

MODULAR RAIL FENCE

BACKGROUND OF THE INVENTION

The present invention relates to fences and is concerned in particular with rail fences having a modular construction that permits easy erection, change and removal.

Hitherto the erection of a rail fence was often a tedious and troublesome task since it involved the digging of post holes, the erection of posts, often with concrete bases, and the securing of the fence rails to the posts. Erection was many times complicated by differences in post spacing that made necessary the use of rails of different lengths. It was also often necessary to provide a plurality of types of posts. Thus for example, straightaways, corners, and gates would, on occasion, require different post designs.

It is an object of the present invention to provide a rail fence that is of simple, modular construction, that is easy to erect and to remove, and which requires a minimum of special construction.

SUMMARY OF THE INVENTION

The above-mentioned object is accomplished by the fence described and illustrated herein. This novel fence is characterized by rails of predetermined, standard length; posts that comprise a shell surrounding and supported by a length of metal pipe merely driven into the ground, the shells being assembled to provide posts of the various types required, such as posts for corners and gates, as well as line posts; and connecting devices that are easily and quickly installed for joining the posts and rails. Such fence structures lend themselves easily to erection by unskilled labor and can be readily assembled on the site. Fencing according to the invention can be easily removed and re-erected at another location when desired, or rail sections can be removed and replaced by a gate. Unevenness in the fenced terrain is not a problem and a wide variation in the type, size, and number of rails used is possible.

DESCRIPTION OF THE INVENTION

Figure 1:
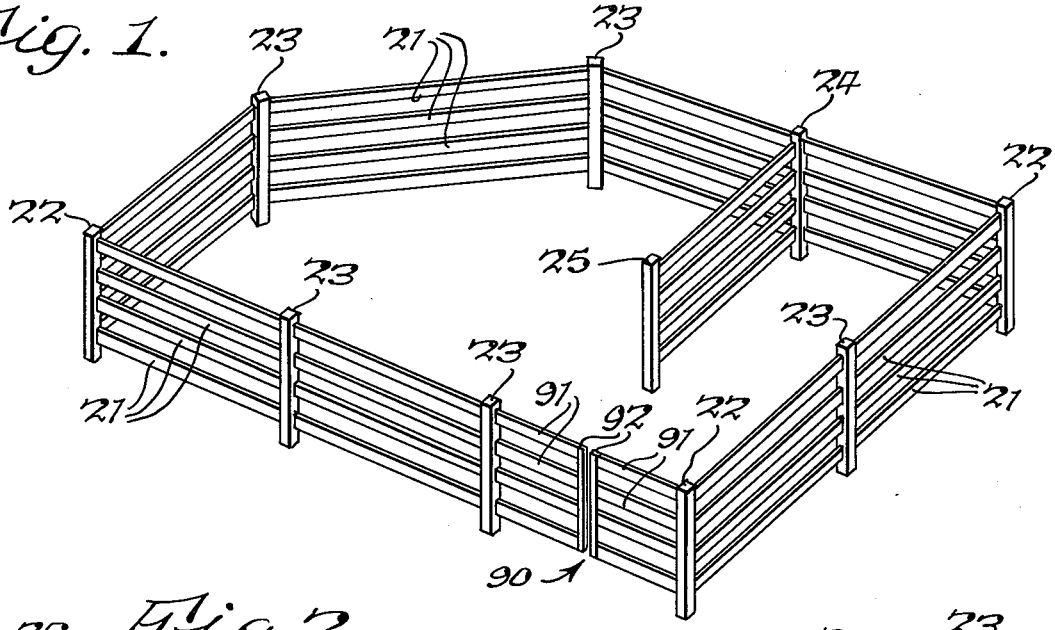
FIG. 1 is a perspective view of a fenced area in which fence according to the present invention is used.

Referring to FIG. 1 there is depicted an enclosure formed of fencing embodying the invention of the present application which includes a plurality of rails 21 and posts 22, 23, 24, and 25 on which the rails are mounted in properly spaced position. This figure illustrates the ease with which the novel fence of the invention can be used in enclosing an area of irregular shape as hereinafter explained. In this figure and FIGS. 2 – 4, inclusive, all of the rails 21 are identical. Each consists of a relatively thin, rectangular board having cut-out portions 27 at its corners. There is thus formed at each end of the rail a longitudinally extending tongue 28 of reduced width. While the rails may be of any desired length, it has been found that a length of about 8 feet is generally convenient.

The posts 22, 23, 24 and 25 are ordinarily formed principally of wood and are preferably supplied in knocked-down form for assembly on the job. If desired, however, the post shells or outer portions can be preassembled. As is clear from FIGS. 3 and 4, the shells of corner posts 22 and line posts 23 are formed from the same components: 2 main, elongated side members 30 of rectangular cross section, 2 large, elongated side members 32 of trapezoidal cross section, 2 small, elongated side members 32 of trapezoidal cross section, and 4 relatively thin backing and spacing strips 33 and 34 of rectangular cross section. The side members and the strips 33 are preferably all the same length and the two backing and spacing strips 34 are preferably somewhat shorter. Each of its posts 22 and 23 also comprises a base 37, a cap 38, and a vertical centering and supporting member, preferably in the form of a metal pipe section 40 which, as hereinafter described, is driven into the ground.

In assembling one of the posts 22, for example, a shell that is square in cross section is made by securing together the two main side members 30 at right angles, securing one of the large side members 31 of trapezoidal cross section (hereinafter referred to as a "major trapezoidal member") to the free end of one of the members 30, securing one of the small side members 32 of trapezoidal cross section (hereinafter, referred to as a "minor trapezoidal member") on the side of the other main side member 30 at right angles thereto, and completing the fourth corner with a composite made by securing together, with their parallel sides at right angles, the other major trapezoidal member 31 and the other minor trapezoidal member 32. As will be seen from FIG. 4, this results in an elongated box-like structure having vertical slots or openings 43 in the middle of each of two adjacent sides, said openings having inwardly diverging walls. The backing and spacing strips 33 are employed to hold together the pairs of major and minor trapezoidal members that form vertical slots or openings 43 on each of two sides of the post 22, and to close such openings.

While other means can be employed, it is preferred to use screws (not shown) in assembling posts according to the invention. Also, preferably the strips 33 are first attached to the paired trapezoidal members 31 and 32, then the strips 34 are attached to the inside surfaces of the main side members 30, and then, after fastening the main side members 30 together, the two composite members formed by joining each of trapezoidal members 31 with a trapezoidal member 32 are secured together and to the main side members. The resulting post shell structure is square in cross section and solid on two sides, has a central vertical wedge-shaped slot or opening 43 on each of the other two sides for mounting the rails 21, and has an interior, vertical passage 45 that is generally square in cross section and is adapted to snugly receive the supporting metal pipe 40.

The line posts 23 are constructed from the same parts or elements as the corner posts 22 and are assembled in substantially the same way except that the pairs of trapezoidal members 31–32 and the long backing or spacing strips 33 are arranged and joined to the main side members so as to provide the rail-mounting vertical slots 43 on opposite sides of the post, instead of on adjacent sides.

Secured to the bottom of each of the posts 22 and 23 is a base or ground plate 37 which is preferably square in cross section and has the same horizontal dimensions as the shell of the post. Screws are preferably used to secure the base to the vertical members from which the post is constructed. Centered in the base 37 is a hole just slightly greater in diameter than the pipe 40. Thus the bases 37 serve not only to strengthen the posts and provide firm footings therefor, but also to guide the supporting pipes 40 when they are driven into the ground.

Erection of the novel fencing of the present invention is relatively uncomplicated and can be readily carried out by unskilled persons. Although other sequences of operation can be used, a simple procedure for erection is as follows:

At the desired, predetermined location for a corner post 22 the preassembled post shell with base attached is placed in a vertical position and a metal pipe 40 is inserted in the longitudinal passage 45 of the post and through the hole in the base. While the post is held vertical, the pipe is driven into the ground to the desired depth. A depth of about two feet is usually sufficient and generally satisfactory results are obtained if the portion of the pipe 40 left above ground is only about 60% – 75% as long as the height of the post. Spacing of a line post 23 adjacent to the corner post 22 is accomplished by temporarily mounting, by means hereinafter described on the already erected corner post a rail 21 of the desired length. This rail is also temporarily connected to the shell of the line post 23 which is to be erected, thus serving to space the latter the correct distance. The assembled line post shell is then held in vertical position and a supporting pipe 40 therefor is driven into the ground as described above. This procedure of spacing the posts by the use of temporarily connected rails 21 may be continued until the area to be fenced is enclosed.

Figure 2:
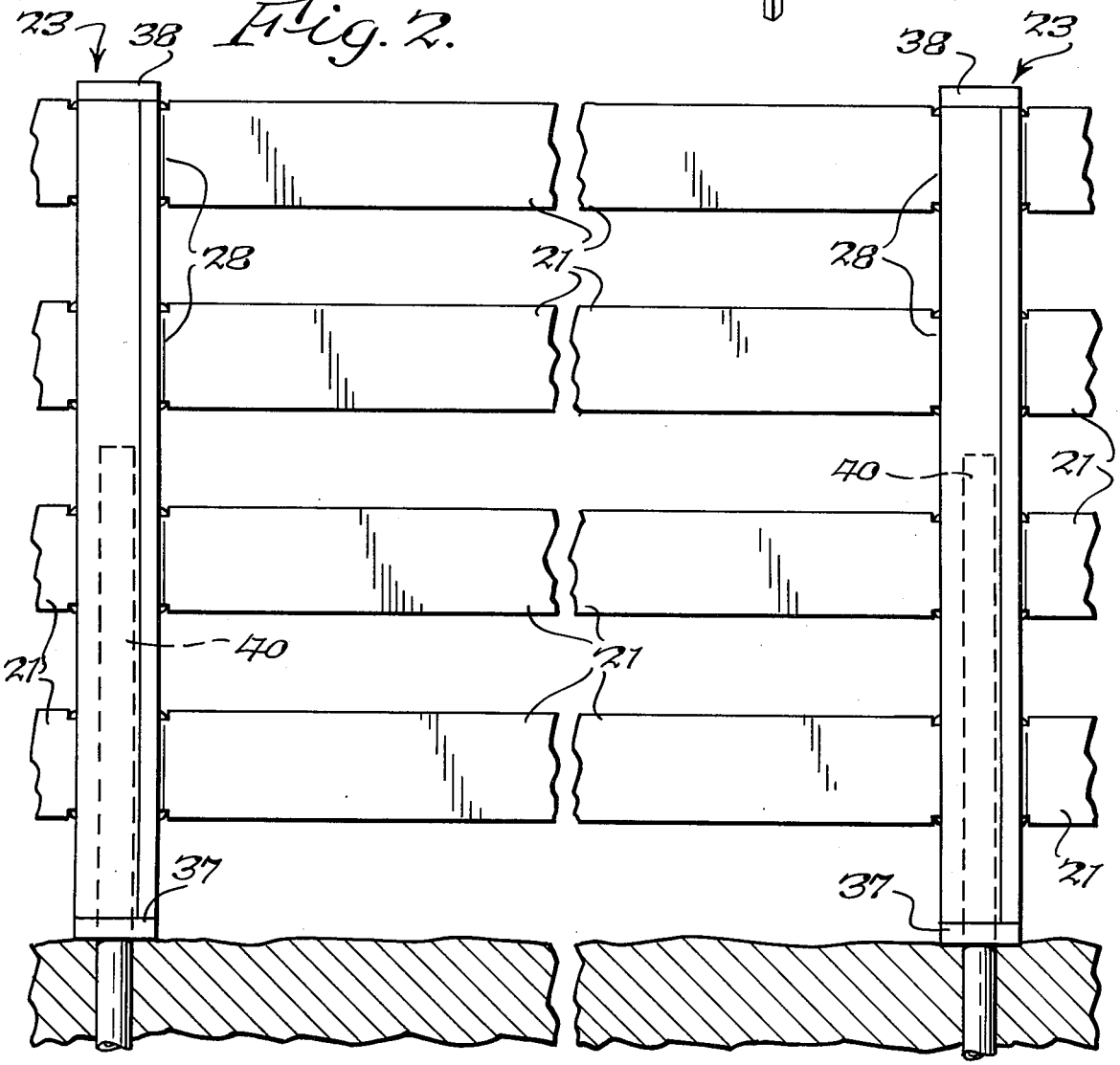
FIG. 2 is an enlarged fragmentary side view of a section of fence according to the invention.
Figure 3:
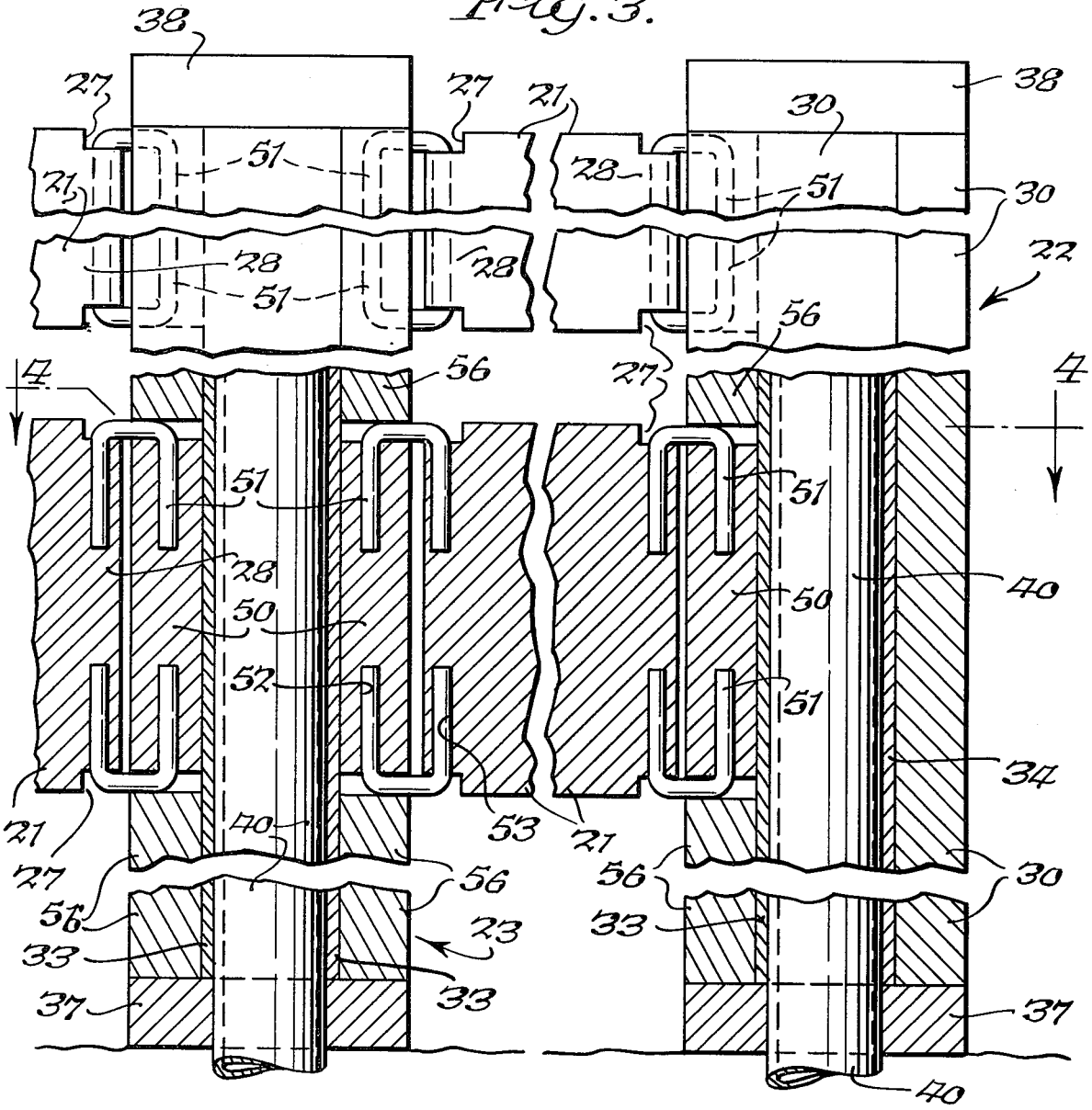
FIG. 3 is a further enlarged fragmentary side view, partly in section, which shows details of the posts and the mounting of the rails.
Figure 4:
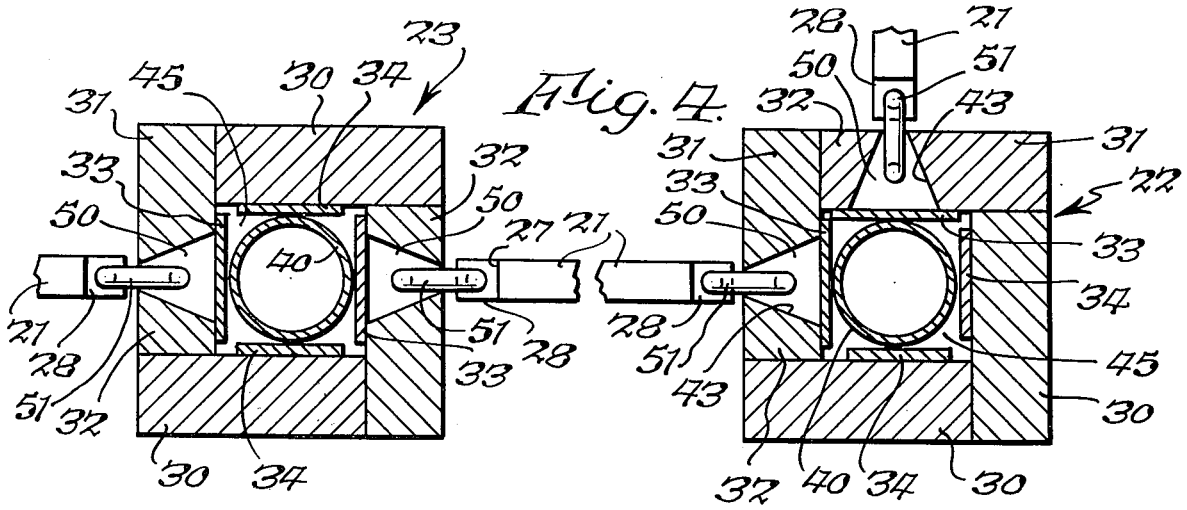
FIG. 4 is a horizontal sectional view taken on line 4—4 of FIG. 3.

As mentioned above, the length of the rails 21 can be varied as desired, thus determining the number of line posts 23 required. The rails may also vary as desired in their other dimensions in accordance with their length, material, contemplated conditions of use, and desired appearance. In FIGS. 1 and 2 the fence illustrated employs four equally spaced identical rails per section all mounted in the same way, as shown in FIGS. 3 and 4. However, both the number of rails and their spacing may be varied and rails of different designs may be used together. Also, of course, there may be variations in the mounting of the rails on the posts.

As seen most clearly in FIGS. 3 and 4, a plurality of support blocks 50 and U-pin hinges 51 may be used as mounting means to secure the fence rails 21 in place between adjacent posts. Each of the support blocks 50, which are preferably formed of wood but may be of any desired material, is trapezoidal in cross section and of such size as to fit within the vertical slots 43 in the sides of the post shells. They are preferably the same length as the width of the tongues 28 on rails 21. Vertically aligned bores 52 are provided in the ends of the blocks 50 and a bore 53 is also provided in the top and the bottom of each rail tongue 28 adjacent the free end thereof. The bores 52 and 53 are of such diameter as to freely receive the ends of U-pins 51, thereby permitting some horizontal pivoting of the rail with respect to the posts.

The rails 21 are vertically located and spaced by the use of spacer blocks 56. In the embodiment of FIGS. 3 and 4 the blocks 56 are trapezoidal in cross section, fitting the slots 43, and of such length as to produce the desired vertical spacing of the rails. As shown in FIG. 3, the bottom spacer block rests on the bottom plate 37. At the desired levels, support blocks 50 are used for connection of the rails. All of the blocks 50 and 56 are inserted in the vertical side openings or slots 43 of the post shells from the tops of the latter and the U-pins 51 are inserted in the bores 52 and 53 in the support blocks and rails, respectively, before the support blocks are placed in the openings 43. The pins 51 are held in place by the spacer blocks 56 above and below them in the slots 43.

As hereinafter described, a variety of modifications can be made in fence construction according to the present invention. By use of one or more of such modifications installation of fencing according to the present invention is permitted or facilitated under special circumstances, e.g. where the terrain is uneven. Other modifications provide simplified construction for use in special instances. For convenience, the modifications are illustrated in connection with a line post 23. It will be understood, however, that they may be used in connection with any other type of post, if desired.

Figure 5:
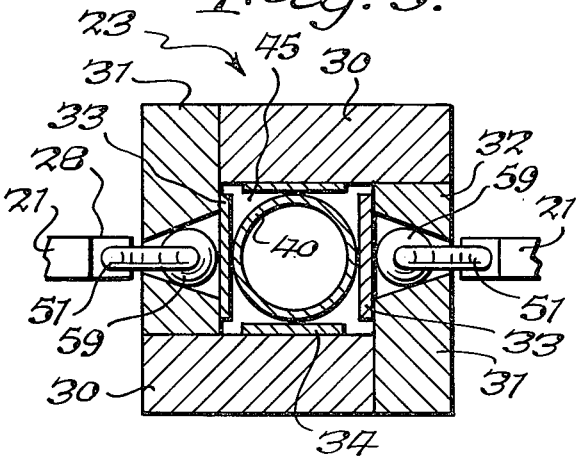
FIGS. 5 and 6 are, respectively, a fragmentary horizontal section and a fragmentary vertical view, partly in section, illustrating a modified mounting for rails.
Figure 6:
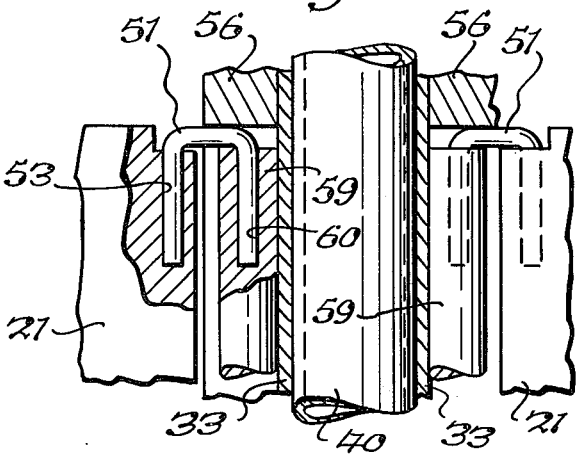

FIGS. 5 and 6 illustrate a modification which facilitates horizontal angular movement of the fence rails with respect to the posts so that adjacent sections of the fence can be at angles other than 180° to each other. In this modification the construction of the rails and posts is the same as in FIGS. 2 – 4 and the mounting means is substantially the same except for the use of dowels 59, having a circular cross section, for support blocks instead of the support blocks 50 that have a trapezoidal cross section. The dowels 59 have bores 60 in their ends for receiving the ends of U-pins 51 and are supported at the desired levels in the slots 43 by spacer blocks 56 in the same way as the blocks 50.

Figure 7:
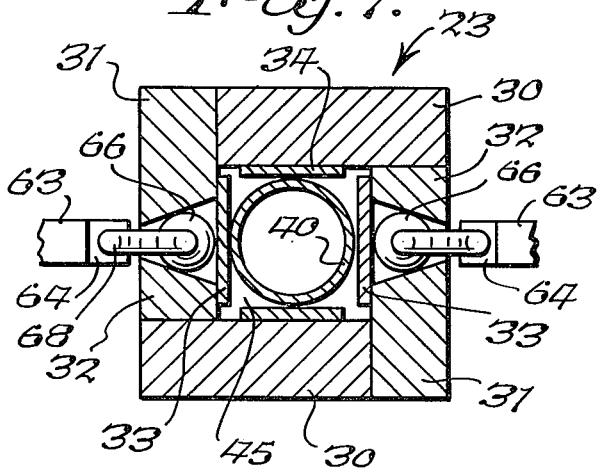
FIGS. 7 and 8 are, respectively, a fragmentary horizontal section and a fragmentary vertical view, partly in section, illustrating another modified mounting for rails.
Figure 8:
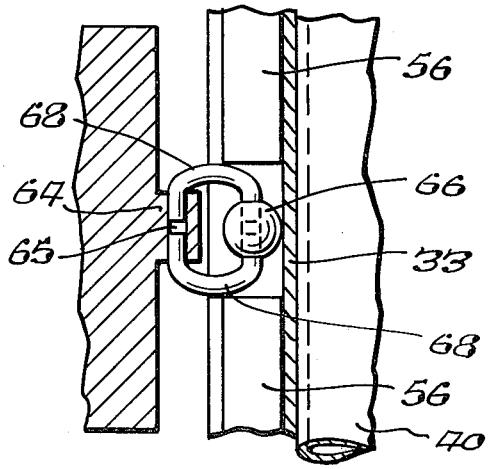

FIGS. 7 and 8 illustrate another modification. In this embodiment not only is horizontal angular movement of the rails with respect to the posts facilitated, but vertical angular movement thereof is also permitted. As shown, both the fence rails and the support thereof in the posts 23 are modified. The rails 63 are provided at their ends with narrow longitudinal tongues 64 provided with vertical bores 65. The mounting means for each end of the rail 63 comprises a ball 66 having a central bore 67 therethrough. The balls 66 and tongues 64 are joined by U-pins 68, the legs of which are shorter than those of the U-pins 51, that extend into the bores 67 and 65, respectively. As in the embodiment of FIGS. 2 – 4, the U-pins are held in place by spacer blocks 56 above and below the balls 66 in the vertical side openings or slots 43 of the post shells. It will be seen in FIG. 8 that the curvature of the pins 68, where the legs and base thereof meet, permits vertical angular movement of the balls 66 without vertical movement of the spacer blocks 56. The balls 66 can be formed of any suitable material, for example, metal or a durable rigid plastic.

Figure 9:
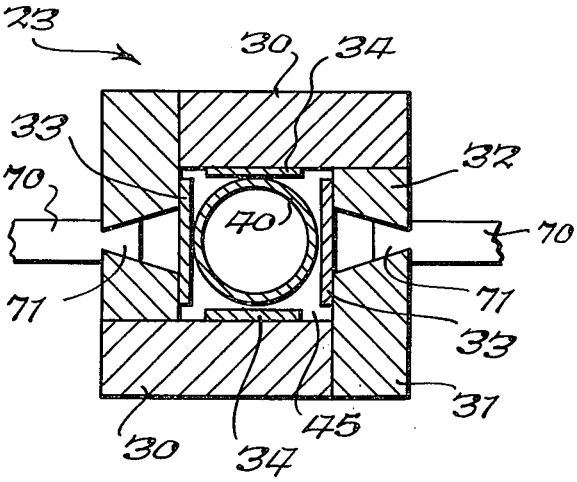
FIG. 9 is a fragmentary horizontal section showing the mounting of a modified form of rail.
Figure 10:
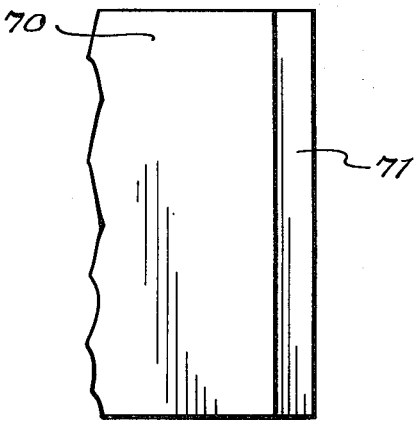
FIG. 10 is a fragmentary side view of the modified rail shown in FIG. 9.

In the embodiments described above, angular horizontal movement of the rails with respect to the posts is secured by the use of mounting means including U-pins. It will be evident that if the diameter of the base of such pins is materially smaller than the width of slots 43 at their outer ends, the degree of possible horizontal movement is increased. In installations where a relatively rigid connection is desired between the rails and the posts, the modification illustrated in FIGS. 9 and 10 is available. In this embodiment, the rails 70 are provided at their ends with dovetails 71 that are slidably receivable in the vertical side openings or slots 43 of the post shells. The rails are held at the desired levels by spacer blocks such as are used in the embodiment of FIGS. 2 – 4. In this embodiment, of course, there is no need for U-pins.

Figure 11:
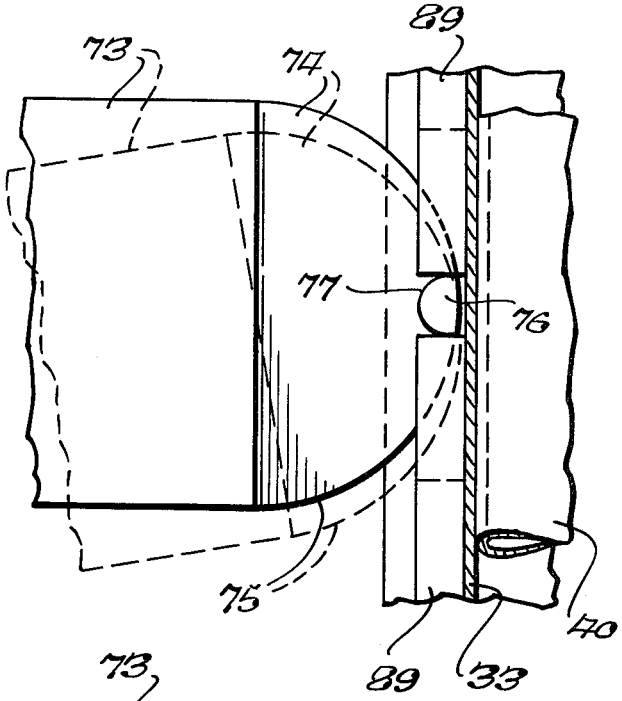
FIG. 11 is a fragmentary side view, partly in section, showing a modified form of rail and illustrating how vertical angular motion is possible therewith.
Figure 12:
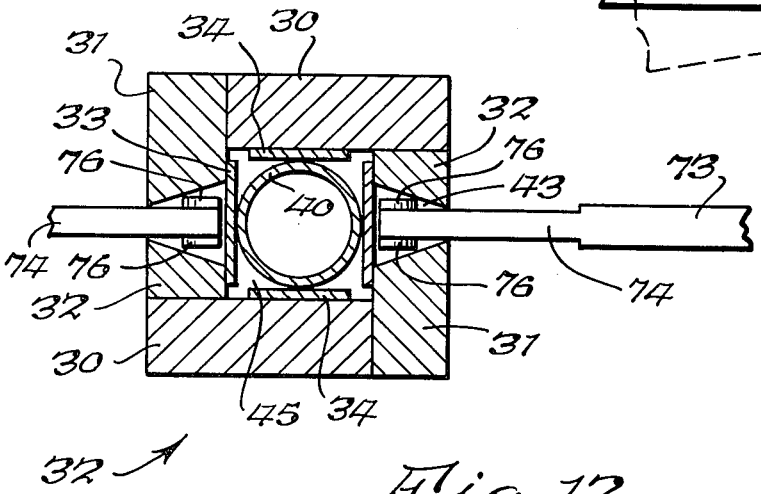
FIG. 12 is a fragmentary horizontal section similar to FIG. 5 showing the mounting of the rail shown in FIG. 11.

FIGS. 11 and 12 illustrate another modification designed to permit vertically angular movement of the rails with respect to the posts. The rails 73 employed in this embodiment have a longitudinally extending, thin tongue 74 at each end. The tongues are, as indicated at 75, arcuately rounded. On each side of each of the tongues 74 at the middle of the edge of the arcuate portion thereof is secured, by suitable means, a pivot plate 76 of suitable material. Although the pivot plates 76 may vary in shape, they are provided with arcuate portions 77 directed away from the ends of the rails. Thus, the rails 73 can swing vertically, as indicated by broken lines in FIG. 11, when the ends of the tongues 74 are located in the vertical side openings or slots 43 of the posts as shown in FIG. 12. When so swinging, the arcuate portions 77 of the pivot plates 76 contact the walls of the vertical slots or openings 43 in the posts.

Figure 13:
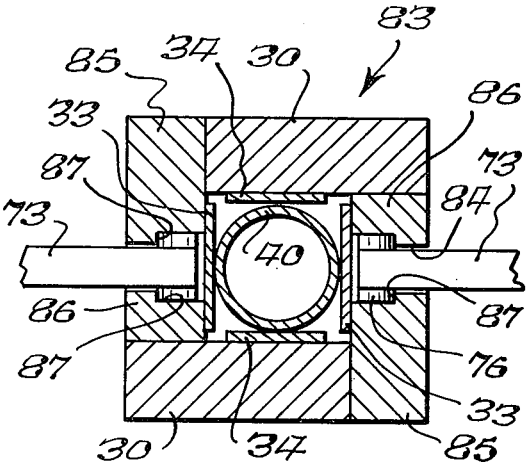
FIG. 13 is a fragmentary horizontal section showing a still further modified rail and details of the mounting thereof.

The further modification illustrated in FIG. 13 is quite similar to the form shown in FIGS. 11 and 12. The rails 73 may be constructed in the same way as the rails in FIGS. 11 and 12 and the line post 83 is quite similar to the posts 23, having a central longitudinal opening 82 for a supporting pipe 45. However, instead of providing rail-mounting slots in the post that are trapezoidal in cross section for mounting the rails 73, the posts 83 are formed with slots 84 having parallel sides. The slots are produced by substituting for the major trapezoidal side members 31 and the minor trapezoidal side members 32 of the post 23, major and minor side members 85 and 86, respectively, and joining the substituted members in pairs by suitably securing them to a backing strip 33 in horizontally spaced relation. Longitudinal rabbets are provided in each of the major and minor side members 85 and 86 along their interior facing edges so as to enlarge the slots 84 at their inner ends and provide shoulders 87 on which the arcuate portions 77 of the pivot plates 76 may bear and ride when the vertical angle of the rail 73 is changed from 90° with respect to the post.

It will be evident that the embodiments illustrated in FIGS. 11 – 13 will permit the use of the modular fence of the present invention on uneven terrain without having to modify the rails or the posts.

The pivot plates 76 used in the embodiments of FIGS. 11 – 13 can be made of any suitable material which is strong and wear resistant, e.g. metal and certain plastic materials. They may be secured to the rails 73 by adhesives or be fastened by mechanical means, e.g. rivets or screws (not shown). The rails 73 may be spaced, when the construction of either FIGS. 12 or 13 is used, by the insertion between the rails of spacer blocks 89 which have curved end portions accommodating the arcuate ends 75 of the rails when the rails pivot. It will be understood that here, as well as in the use of other embodiments illustrated, the cross-sectional shape of the spacer blocks is not critical.

When assembly of the rails in a section of fence according to the invention is completed, the section may be stabilized and finished by filling the longitudinal passages 45 in the posts around the pipes 40 with sand and after insertion of additional spacer blocks if necessary to fill up the vertical slots in the post shells, securing a cap or cover 38 thereon. The covers may be of wood and screwed to the tops of the posts or may be formed from other suitable material and mounted as desired.

When completed, the modular fence is sturdy and resistant to normal stresses. If, however, some damage should occur to one or more sections, e.g. a rail is broken, repair is easy since it is only necessary to remove the caps 38 from the adjacent posts and mount another rail in place of the damaged one. It is also possible to remove the fence easily, if desired. This can conveniently be done by removing the caps from the posts and then removing the spacer blocks and support blocks with the rails attached thereto. The post shell can then be lifted from the supporting pipe. In the event this is difficult, a stream of water, e.g. from a hose, may be directed into the central longitudinal passage of the post. This will wash out sufficient of the sand that fills the passage to allow the post shell to be raised. It is only necessary then to pull out the pipe which can be easily done since it is not embedded in concrete as is frequently the case with fence posts.

The post 24 (see FIG. 1) is both a corner post and a line post in that it has rails attached to three sides thereof. Its construction is substantially similar to the posts 22 and 23 hitherto described in detail except for the fact that in the post shell there is only one main side member 30 and that a vertical slot or side opening is provided on a third side of the post by use of an additional large trapezoidal side member 31 and an additional small trapezoidal side member 32. The end post 25 is also substantially similar to posts 22 and 23 except for the fact that three main side members are used in constructing it and only one vertical slot is provided for mounting rails. Although it is not illustrated, it will be evident that, if desired, a post having four vertical rail mounting slots could be constructed so that rails could be attached to all four sides of the post. Such a post is considered to be within the scope of the present invention.

As mentioned above, the present invention permits the easy installation of gates and, if desired, their removal or replacement. The gate designated 90 in FIG. 1 illustrates this. The same spacing between posts can be used as is used in erecting the stationary sections of fence. The gate 90 is constructed from specially produced short rails or from regular rails such as the ones designated 21 by sawing them in half. The ends of the short rail sections 91 having mounting tongues e.g. as shown at 28, are mounted on the posts on either side of the gate opening by means that permits the rail sections to swing horizontally, but not vertically. Although other means can be used, the rail mounting means shown in FIGS. 5 and 6 is suitable. The free ends of each set of rail portions 91 are secured together by suitable means such, e.g. as by screwing or nailing end trim members 92 thereto while keeping the desired spacing between the rail portions. It will be evident from the foregoing that, if desired, a fence section can be readily removed and a gate installed or vice versa.

The terms "upper", "lower", "top", "bottom", "right", "left" "above", "below", "vertical" and "horizontal" and similar terms of position and/or direction as used herein refer to the illustrations but are used only for convenience in description and/or reference. Such terms should not be so construed as to imply a necessary positioning of the structure or portions thereof or to limit the scope of this invention.

In the foregoing disclosure, it has been made clear that there is provided by the present invention a novel, simple modular fence that is easy to erect and requires a minimum of special construction or measurement. It will be seen that both the rails and the post shells can be prefabricated, in different designs or styles if desired, and that the fence can be put up speedily, as described above, from the proper assortment of posts and the necessary number of rails. The support blocks are, of course, of a size to match the rails and the spacer blocks can be furnished in standard lengths to provide for any desired rail spacing. On the other hand, it will be seen that both the posts 22 and 23 are formed from the same, identical members. Thus, these posts can be procured by the prospective fence builder in prefabricated but unassembled kits and can be easily assembled, as described above, to provide either corner posts or line posts as desired. It will also be observed that a 3-way post 24 and an end post 25 together require exactly the same elements or parts as two line posts or two corner posts. Thus kits adapted to use in assembling any desired combination of posts can be provided. Obviously, the height of the posts is a matter of choice and they may be provided in a range of sizes or cut to size during installation.

The novel fence of the invention can be used on uneven terrain, can be angled as desired, uses no concrete post bases and is easily repaired and/or removed. Thus, it is relatively inexpensive. At the same time, as explained above, the number of rails used per section, the width of the rails, and their design can be varied as desired so that a wide variety of pleasing and useful effects can be obtained.

We claim:

1. A modular rail fence construction comprising a plurality of fence posts and rails between and removably supported by said posts characterized in that: both line posts and corner posts of said fence are formed from the same elements; each said post comprises a base, a cap, a shell, and a separate centering and supporting member; said shell is rectangular in cross section and has longitudinally extending slots in two outer side faces thereof and together with said base forms a composite member fitting around said centering and supporting member; each of said rails is provided with mounting means extending into one of said slots in each of a proximate pair of said posts and removably secured in said slots, and separate rail spacing members are provided in said slots.

2. A fence construction as defined in claim 1 wherein said centering and supporting member is a length of pipe extending into the ground.

3. A fence construction as defined in claim 1 wherein said slots contain removable mounting members and said rails are removably engaged with said mounting members.

4. A fence construction as defined in claim 1 wherein said mounting means is integral with said rails.

5. A fence construction as defined in claim 3 wherein said rail mounting means comprises a pair of U-pins.

6. A fence construction as defined in claim 1 wherein said rail spacing members are removably positioned between said mounting members.

7. A fence construction as defined in claim 1 wherein said slots are trapezoidal in cross section.

8. A fence construction as defined in claim 7 wherein said mounting members are trapezoidal in cross section.

9. A fence construction as defined in claim 7 wherein said mounting members are circular in cross section.

10. A fence construction as defined in claim 6 wherein said mounting means comprises a pair of U-pins.

11. A fence construction as defined in claim 10 wherein said slots are trapezoidal in cross section.

12. A fence construction as defined in claim 11 wherein said mounting members are circular in cross section.

13. A fence construction as defined in claim 11 wherein said mounting members are circular in cross section.

14. A fence construction as defined in claim 12 wherein said centering and supporting member is a length of pipe extending into the ground.

15. A fence construction as defined in claim 13 wherein said centering and supporting member is a length of pipe extending into the ground.

16. A fence construction as defined in claim 5 wherein one leg of each of said U-pins is pivotally mounted in a rail and the other end thereof is mounted in a removable mounting member.

17. A fence construction as defined in claim 1 wherein said mounting means are rigidly secured to said rails.

18. A fence construction as defined in claim 1 wherein said mounting means permit vertical angular movement of said rails with respect to said posts.

19. A fence construction as defined in claim 2 wherein said mounting means are rigidly secured to said rails.

20. A fence construction as defined in claim 2 wherein said mounting means permit vertical angular movement of said rails with respect to said posts.

21. A fence construction as defined in claim 1 wherein said mounting means are rigidly secured to said rails and permit vertical angular movement of said rails with respect to said posts.

22. A fence construction as defined in claim 21 wherein said centering and supporting member is a length of pipe extending into the ground and said rail spacing members are removably positioned between said mounting members.

* * * * *

UNITED STATES PATENT OFFICE

CERTIFICATE OF CORRECTION

PATENT NO. : 3,993,289

DATED : November 23, 1976

INVENTOR(S) : Edward Lewis and Edward Michalowski

It is certified that error appears in the above-identified patent and that said Letters Patent are hereby corrected as shown below:

In claim 12, line 2, "circular" has been changed to --trapezoidal--.

Signed and Sealed this

Eighth Day of March 1977

[SEAL]

*Attest:*

RUTH C. MASON
*Attesting Officer*

C. MARSHALL DANN
*Commissioner of Patents and Trademarks*